US008157000B2

(12) United States Patent
Johnston

(10) Patent No.: US 8,157,000 B2
(45) Date of Patent: Apr. 17, 2012

(54) HEAT EXCHANGER CORE

(75) Inventor: Anthony Matthew Johnston, Double Bay (AU)

(73) Assignee: Meggitt (UK) Ltd., Christchurch, Dorset (GB)

( * ) Notice: Subject to any disclaimer, the term of this patent is extended or adjusted under 35 U.S.C. 154(b) by 1252 days.

(21) Appl. No.: 10/554,682

(22) PCT Filed: May 4, 2004

(86) PCT No.: PCT/AU2004/000577

§ 371 (c)(1),
(2), (4) Date: Apr. 27, 2006

(87) PCT Pub. No.: WO2004/099696

PCT Pub. Date: Nov. 18, 2004

(65) Prior Publication Data

US 2006/0254759 A1 Nov. 16, 2006

(30) Foreign Application Priority Data

May 6, 2003 (AU) ..... 2003902200

(51) Int. Cl.
*F28D 7/02* (2006.01)
*F28F 3/14* (2006.01)

(52) U.S. Cl. ..... 165/167; 165/170

(58) Field of Classification Search ..... 165/165, 165/166, 167, 170, 174, 153
See application file for complete search history.

(56) References Cited

U.S. PATENT DOCUMENTS 3,106,243 A * 10/1963 Knudsen ..... 165/167
3,216,495 A * 11/1965 Johnson ..... 165/166
4,535,840 A * 8/1985 Rosman et al. ..... 165/167
4,595,170 A 6/1986 Livet
4,665,975 A * 5/1987 Johnston ..... 165/167
4,763,488 A * 8/1988 Johnston ..... 62/497
6,167,952 B1 * 1/2001 Downing ..... 165/167
6,228,341 B1 * 5/2001 Hebert et al. ..... 423/352
6,274,101 B1 * 8/2001 Sechrist ..... 422/198
7,040,387 B2 * 5/2006 Leuthner et al. ..... 165/166
7,125,540 B1 * 10/2006 Wegeng et al. ..... 423/650

FOREIGN PATENT DOCUMENTS

JP 60057081 A 4/1985

(Continued)

*Primary Examiner* — Tho V Duong

(74) *Attorney, Agent, or Firm* — Rothwell, Figg, Ernst & Manbeck, pc

(57) ABSTRACT

A heat exchanger core incorporating diffusion bonded plates and heat exchangers incorporating such core are disclosed. The heat exchanger core comprises first and second groups of interleaved plates which are arranged respectively to carry first and second heat exchange fluids, and each of the plates in each group is formed in one of its faces with thirty or more platelets, each of which is composed of a group of parallel channels. Ports extend through the first and second groups of plates for conveying the first and second heat exchange fluids to and from the platelets, and distribution channels connect opposite ends of each platelet in each of the plates to associated ones of the ports. The distribution channels that are associated with each of the platelets in the plates of the first group are disposed in intersecting relationship with the distribution channels that are associated with respective ones of the platelets in the plates of the second group whereby each one of the platelets in the plates of the first group is located in heat exchange juxtaposition with a respective one of the platelets in the plates of the second group.

29 Claims, 7 Drawing Sheets

FOREIGN PATENT DOCUMENTS

| | | | |
|---|---|---|---|
| JP | 61026898 | A | 2/1986 |
| JP | 61-175763 | U | 11/1986 |
| JP | 61175763 | U | 11/1986 |
| JP | 61268981 | A | 11/1986 |
| JP | 2071244 | A | 3/1990 |
| JP | 3025675 | A | 2/1991 |
| JP | 4-33881 | U | 3/1992 |
| JP | 5-45476 | U | 6/1993 |
| JP | 8271175 | A | 10/1996 |
| JP | 11063860 | A | 3/1999 |
| JP | 2001036212 | A | 2/2001 |

* cited by examiner

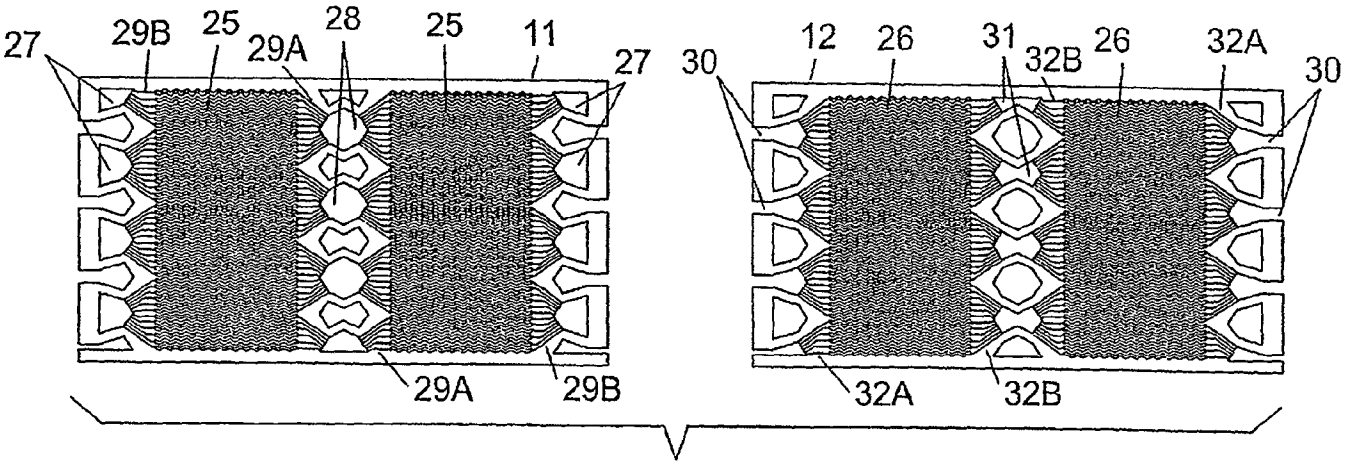
FIG. 5
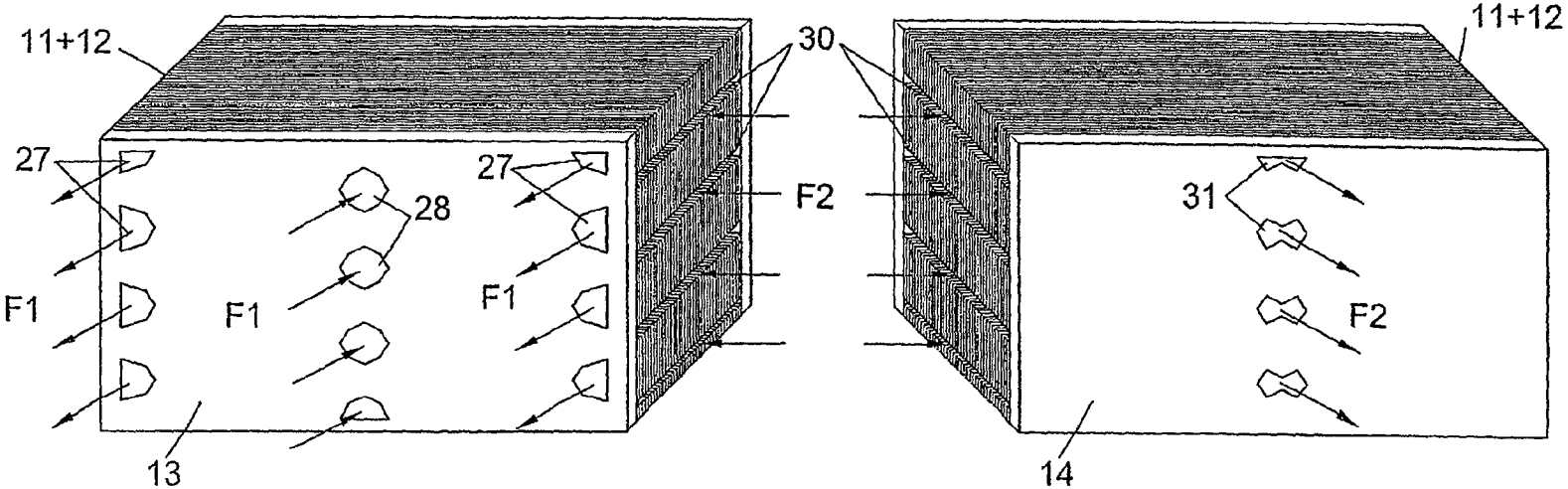
FIG. 7
FIG. 6

HEAT EXCHANGER CORE

CROSS REFERENCE TO RELATED APPLICATION

This application is a 35 U.S.C. §371 National Phase Entry Application from PCT/AU2004/000577, filed May 4, 2004, and designating the U.S.

FIELD OF THE INVENTION

This invention relates to a heat exchanger core of a type that is constructed from a plurality of bonded plates, with channels for heat exchange fluids (ie, liquids and/or gases) being formed within at least some of the plates.

BACKGROUND OF THE INVENTION

Heat exchanger cores of the type with which the present invention is concerned, sometimes referred to as printed circuit heat exchanger ("PCHE") cores, were developed initially by the present Inventor in the early 1980's and have been in commercial production since 1985. The PCHE cores are constructed most commonly by etching (or "chemically milling") channels having required forms and profiles into one surface of individual plates and by stacking and diffusion bonding the plates to form cores having dimensions required for specific applications. Although the plates-and channel dimensions can be varied significantly to meet, for example, different duty, environmental, functional and performance requirements, the plates might typically be formed from a heat resisting alloy such as stainless steel and have the dimensions: 600 mm wide×1200 mm long×1.6 mm thick. The individual channels in the respective plates might typically have a semi-circular cross-section and a radial depth in the order of 1.0 mm.

Headers are mounted to the cores for feeding fluids to and from respective groups of the channels in the cores and, depending for example upon functional requirements and channel porting arrangements, the headers may be coupled to any two or more of the six sides and faces of the cores.

The design of PCHE cores or, more specifically, heat exchangers incorporating such cores requires the reconciliation of a number of (sometimes conflicting) considerations which, in the context of the present invention, include the following:

1. Achieving required thermal effectiveness (boundary temperatures) within allowable pressure drops,
2. Minimising the size and/or mass of the heat exchanger, and
3. Configuring a suitable shape for the core and/or porting arrangements for the groups of channels in a manner to facilitate the convenient connection of heat exchange fluids using conventional piping/coupling arrangements.

In researching approaches that might be made toward meeting these requirements the present Inventor has recently determined that, in order to achieve minimisation of the heat exchange area that is required in a given case to meet specified duty requirements, it is necessary to provide plate channels having high levels of tortuosity. However, channels that are configured along their lengths to provide high tortuosity must be made shorter than those having a lower level of tortuosity in order that pressure drop constraints might be met.

Shortening of the channels would not normally create a significant problem in the case of cross-flow heat exchangers. However, it would lead to a reduction in heat exchange/plate area utilisation in the case of the more usual co-flow and counter-flow heat exchangers which inevitably have at least some plates (typically between 50% and 100% of the total number of plates) that effectively incorporate cross-flow channels to direct inflow and outflow of fluid to and from orthogonally extending co-flow or counter-flow fluid channels. That is, if the length of the co-flow or counter-flow channels were to be reduced, the areas of the plates occupied by the cross-flow channels would increase relative to the area occupied by the co-flow or counter-flow channels. This would lead to the requirement for plates having a larger length-to-width ratio if the more usual area relativities were to be preserved and, given the requirement for shorter channels, to the need logically for smaller plates than those that customarily are used in the PCHE cores. This in turn would lead to difficulties with connection of heat exchange fluids using conventional piping/coupling arrangements.

SUMMARY OF THE INVENTION

The present invention seeks to reconcile the abovementioned conflicting requirements by providing a heat exchanger core which comprises first and second groups of interleaved plates which are arranged respectively to carry first and second heat exchange fluids. The plates are bonded to one another and each of the plates in each group is formed in at least one of its faces with at least three platelets, each of which is composed of a group of parallel channels. Ports extend through the first and second groups of plates for conveying the first and second heat exchange fluids to and from the platelets, and distribution channels connect opposite ends of each platelet in each of the plates to associated ones of the ports. The distribution channels that are associated with each of the platelets in the plates of the first group are disposed in intersecting relationship with the distribution channels that are associated with respective ones of the platelets in the plates of the second group, whereby each one of the platelets in the plates of the first group is located in heat exchange juxtaposition with a respective one of the platelets in the plates of the second group.

In stating that the distribution channels that are associated with each of the platelets in the plates of the first group are disposed in "intersecting relationship" with the distribution channels that are associated with respective ones of the platelets of the platelets in the plates of the second group, it is meant that the respective distribution channels "cross" one another without communicating. Thus, in the contest of the invention it is intended that the word "intersecting" be read as in the sense of "passing across" and not as in the sense of "passing through" one another.

In the above defined core arrangement, a group of the platelets is provided in each of the plurality of conveniently-sizes larger plates. The length of each of the platelets may be selected to facilitate a high level of tortuosity in the parallel channels that constitute the platelet and, hence, to provide for optimisation of the heat exchange area of the plate.

OPTIONAL ASPECTS OF THE INVENTION

The heat exchanger core may be constructed to provide for exchange of heat between three or more fluids, with at least some of the plates in each group being arranged to carry more than one fluid. However, for many if not most applications of the invention, the heat exchanger core will provide for heat exchange between the first and second heat exchange fluids only.

At least some of the plates in one or the other of the two groups of plates may be formed with platelets in both faces. In this case, however, spacer plates would also need to be interleaved with the plates in the core in order to preclude contact between different heat exchange fluids. However, it is desirable that each of the plates in each group be formed in one only of its faces with the platelets.

Each of the channels within the multiple groups of channels that form the platelets may be formed so as to impose tortuosity in (ie, to create a tortuous path for) flow of fluid along the channel. This may be achieved in various ways, one of which involves forming each channel to follow a zig-zag path. With channels so formed, the expression "parallel channels" will be understood as covering an arrangement of channels in which the mean paths of the channels lie parallel to one another.

Although, as indicated previously, each plate will carry a minimum of three platelets, there will typically be between three and thirty platelets on each of the plates. Furthermore, the platelets may be arrayed in two columns and, in such a case, there may be a total of between six and sixty platelets on each plate.

The channels within each of the platelets may be formed to extend lengthwise of the plates, in which case the ports will be arrayed across top and bottom marginal portions of the plates. However, the channels desirably are formed to extend transversely across the plates, with the ports being arrayed along marginal side portions of the plates. In the case where the groups of parallel channels are arrayed in two columns, as indicated above as a possibility, the ports may be arrayed lengthwise of the plates in four columns. Alternatively, if a central array of ports is employed to serve oppositely extending groups of parallel channels, the ports will be arrayed lengthwise of the plates in three columns.

The ports may be formed as apertures and all ports may be located wholly within the boundaries of the plates. However, in the case of ports that are located adjacent (side or end) marginal portions of the plates, some or all of such ports may be formed as side-entry or end-entry slots.

The edge portions of the ports from which the distribution channels extend, to connect with the platelets, may be disposed at right angles to the parallel channels that form the platelets (ie, parallel to the ends of the platelets) or, in the case of circular ports, be curved. However, each of the edge portions from which the distribution channels extend is desirably disposed obliquely with respect to the platelets, so as to maximise the edge length from which the distribution channels radiate.

The plates may be bonded to one another by any one of a number of processes, such as welding, brazing or diffusion bonding.

The invention will be more fully understood from the following description of preferred embodiments of heat exchanger cores that provide for counter-flow of two heat exchange fluids. The description is provided with reference to the accompanying drawings.

BRIEF DESCRIPTION OF THE DRAWINGS

In the drawings:

FIG. 5 shows a diagrammatic representation of two successive plates of an alternative core arrangement, FIG. 6 shows the forward face of a core that incorporates the plates of FIG. 5, FIG. 7 shows the back face of the core of FIG. 6.

DETAILED DESCRIPTION OF PREFERRED EMBODIMENTS

Figure 1A:
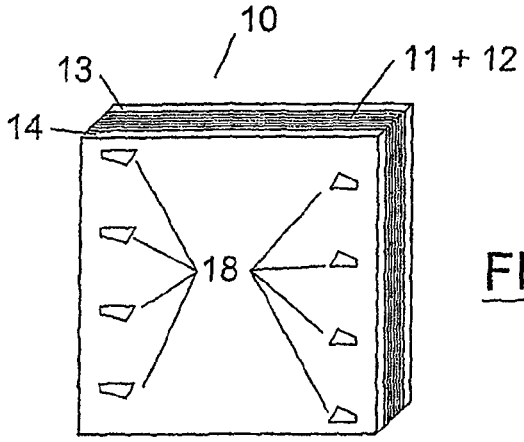
FIG. 1A shows a diagrammatic representation of an elementary core.
Figure 1B:
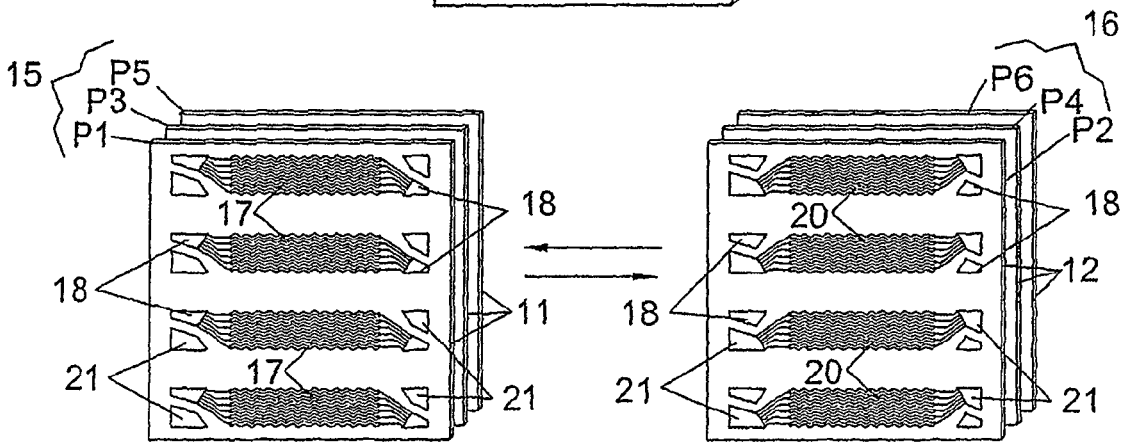
FIG. 1B shows two groups of three plates removed from the core.
Figure 1C:
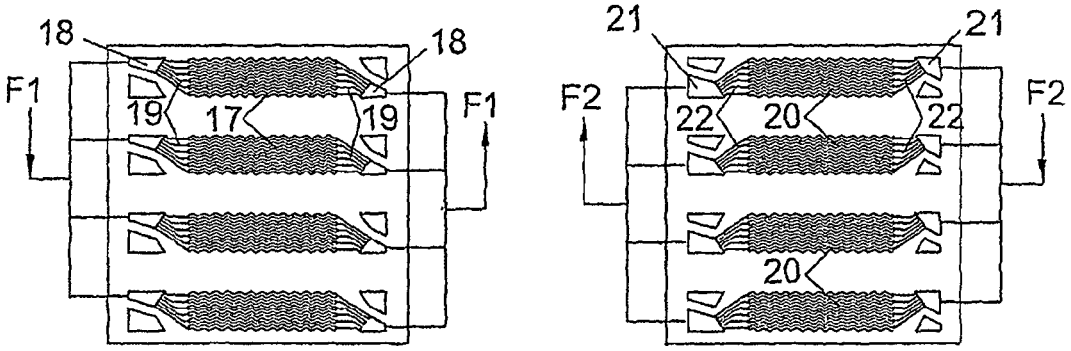
FIG. 1C shows individual plates of the respective groups shown in FIG. 1B.
Figure 2:
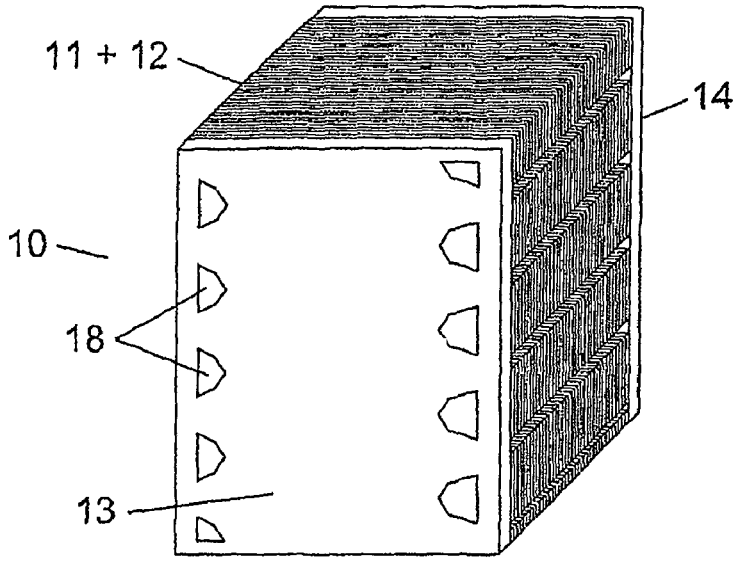
FIG. 2 shows a less diagrammatic representation of the core with a larger number of plates.

As illustrated in FIG. 1, the heat exchanger core 10 comprises a plurality of plates 11 and 12 which are diffusion bonded in face-to-face contact between end plates 13 and 14. All of the plates 11 and 12 may be formed from stainless steel and have a thickness of the order of 1.6 mm.

The plates 11 and 12 are stacked as two groups 15 and 16 of interleaved plates $P_1, P_2, P_3, P_4 - - - P_n, P_{n+1}$, and the respective groups 15 and 16 of plates 15 are arranged in use to carry first and second (counter-flowing) heat exchange fluids $F_1$ and $F_2$.

Each of the plates 11 is formed in one of its faces with multiple, notionally separate, groups 17 of parallel channels which form platelets 17. Each of the platelets 17 (ie, each of the groups of parallel channels) extends transversely across the respective plates, and ports 18 are located at the opposite ends of each of the platelets 17. Also, groups of distribution channels 19 are formed in each of the plates 11 to provide direct fluid connections between the respective ports 18 and associated ones of the platelets 17.

Similarly, each of the plates 12 is formed in one of its faces with multiple groups 20 of parallel channels which form platelets 20. In this case also, the platelets 20 extend transversely across the plates 12 and ports 21 are located at opposite ends of each of the platelets 20. Direct fluid connections are provided between the ports 21 and respective associated platelets 20 by groups of distribution channels 22.

The groups of distribution channels 19 and 22 in the respective groups of plates 11 and 12 are disposed in intersecting relationship (as previously defined). Thus, they are arranged such that the platelets 17 in the plates 11 are positioned in overlapping, heat exchange juxtaposition with the platelets 20 in the plates 12, so that good thermal contact is made between the heat exchange fluids $F_1$ and $F_2$.

The two groups of ports 18 and 21 extend through all of the plates 11, 12, 13 and 14 to permit connection to the interior of the core 10 of the two heat exchange fluids $F_1$ and $F_2$. The plates across which the respective fluids flow are determined by the respective groups of distribution channels 19 and 22. Headers (not shown) are mounted to the core for delivering the heat exchange fluids to and from the core.

The arrangement shown in FIG. 1, with four clearly delineated groups of parallel channels or platelets 17 and 20 in plates 11 and 12 respectively, is intended only to be illustrative of the general concept of the invention. A more realistic representation of the plates 11 and 12 is provided in FIG. 3.

Figure 3:
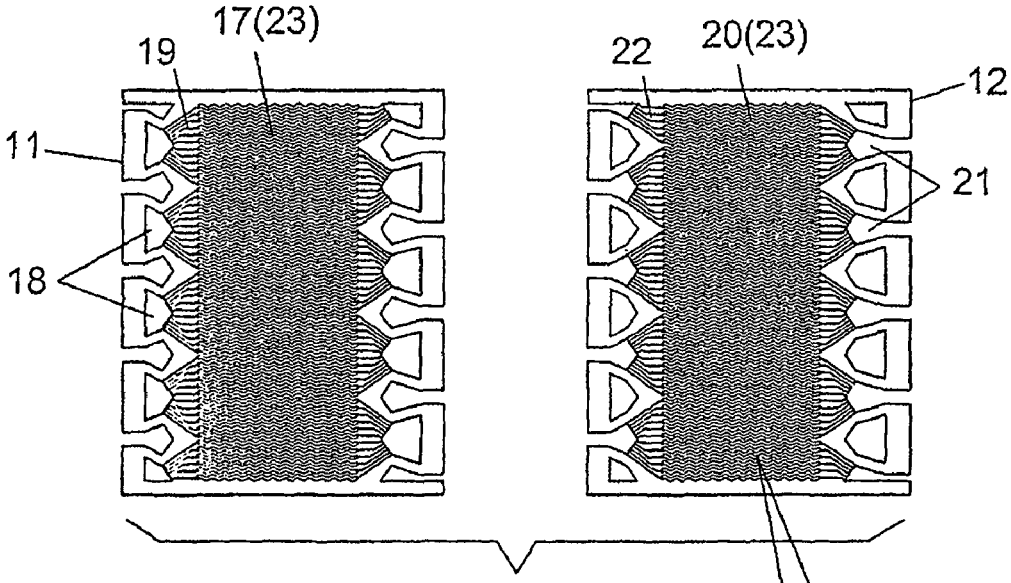
FIG. 3 shows two successive plates removed from the core of FIG. 2.

As illustrated in FIG. 3, the individual platelets 17 are distinguishable from one another only by reference to oppositely positioned distribution channels 19 that connect with the ends of respective ones of the platelets. Similarly, the platelets 20 are distinguished from one another by reference to oppositely positioned distribution channels 22 that connect with the ends of respective ones of the platelets.

The number of platelets 17 and 20 within the respective plates 11 and 12 is maximised, as shown, by arraying the ports 18 and 21 in closely spaced relationship and connecting opposite ends of each of the platelets 17 and 20 to staggered ones of the ports.

Each plate 11 and 12 will typically have the dimensions 600 mm×1200 mm, be formed with ten to twenty platelets 17 and 20, and contain approximately twenty to forty separate, parallel channels 23 within each platelet. Each channel 23 may have a semi-circular cross-section, a radial depth of 1.0 mm, and adjacent channels may be separated by a 0.5 mm wide ridge or land. However, it will be understood that all of these numbers and dimensions may be varied significantly, depending upon the application of the heat exchanger core.

Figure 4:
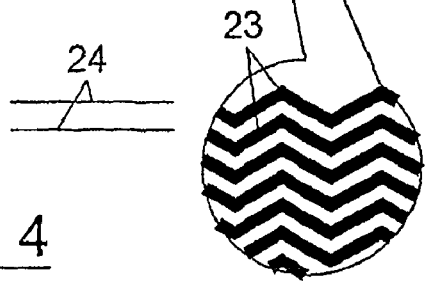
FIG. 4 shows on an enlarged scale a portion of the plates of FIG. 3.

As show in FIG. 4, each of the channels 23 follows a zig-zag path and, to the extent that the channels are described herein as being "parallel", it will be understood that it is their mean paths 24 that lie parallel to one another.

FIGS. 5 to 7 show an alternative arrangement of the core, in which the plates 11 and 12 are formed with two vertical columns of, closely packed, horizontally extending platelets 25 and 26. Each of the platelets 25 and 26 is similar to the corresponding platelets 17 and 20 as shown in FIG. 1 but, in the case of the embodiment shown in FIGS. 5 to 7, six groups of vertically arrayed ports are provided for conveying the heat exchange fluids $F_1$ and $F_2$ to and from the respective plates.

As indicated in FIGS. 5 to 7, the heat exchange fluid $F_1$ is delivered to the core 10 and platelets 25 by way of the single group of vertically arrayed ports 28 and distribution channel groups 29A. The same heat exchange fluid is conveyed away from the core by way of the distribution channel groups 29B and the two groups of vertically arrayed ports 27. Similarly, the heat exchange fluid $F_2$ is delivered to the core and the platelets 26 by way of the two groups of vertically arrayed side-entry ports 30 and the distribution channel groups 32A, and is conveyed from the core by way of the distribution channel groups 32B and the single group of vertically arrayed ports 31.

In order to facilitate connection of the requisite number of inlet and outlet headers (not shown), the ports 27, 28 and 31 are formed as end-entry ports, whereas the ports 30 are formed as side entry-ports. As in the case of the previously described embodiment, all of the ports extend through all of the plates 11 and 12.

Figure 8:
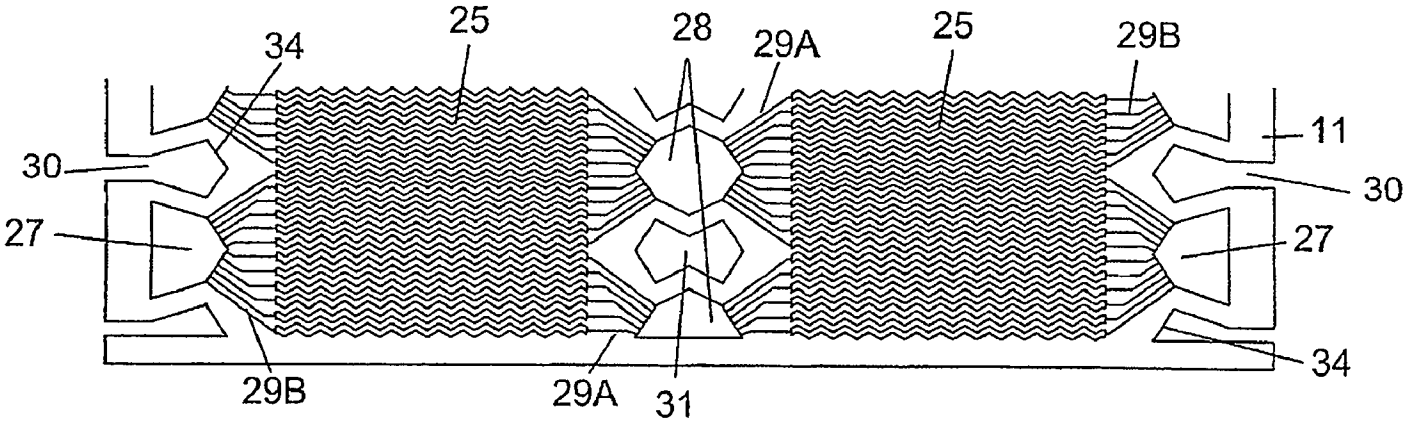
FIG. 8 shows in a less diagrammatic way a lower end portion of one of the plates removed from the core of FIGS. 6 and 7.
Figure 9:
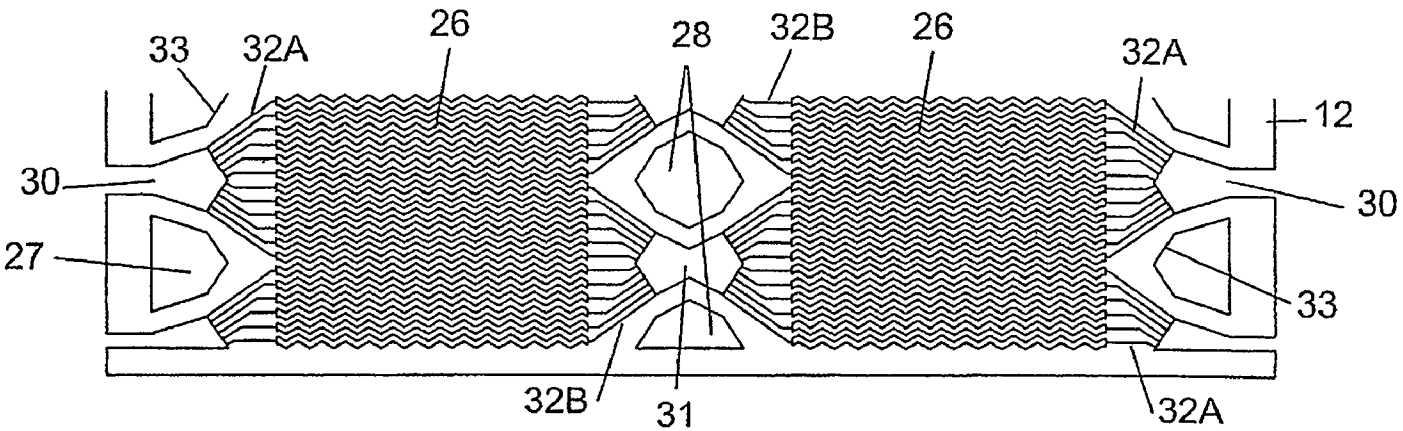
FIG. 9 shows a lower end portion of a succeeding one of the plates removed from the core of FIGS. 6 and 7.

FIG. 8 shows on an enlarged scale a typical realisation of a lower end portion of one of the plates 11 in the embodiment of FIGS. 5 to 7, and FIG. 9 similarly shows a lower end portion of one of the plates 12.

As can best be seen from FIG. 8 (when considered in conjunction with FIGS. 6 and 7), the fluid $F_1$ enters the ports 28 in plates 11, passes into the respective groups of distribution channels 29A, through the oppositely extending platelets 25, through the groups of distribution channels 29B and out through the ports 27. Because the successive plates 11 and 12 carry the different fluids $F_1$ and $F_2$ and all of the ports pass through all of the plates, in order to maximise space utilisation the ports and distribution channels are arranged in a manner such that the fluid passing in each (left and right) direction from a single (full) port 28 divides and exits through two vertically spaced ports 27. Similarly, as can best be seen from FIG. 9, the fluid $F_2$ enters the ports 30 in plates 12, passes into the respective groups of distribution channels 32A, through the oppositely extending platelets 26, through the groups of distribution channels 32B and out through the ports 31. In this case the ports and distribution channels are arranged in a manner such that the fluid passing inwardly from each of the single side-entry ports 30 divides and exits through two vertically spaced centrally located ports 31.

All of the ports 18, 21, 27, 28,30 and 31 have edge portions 33 and 34 (identified in FIGS. 8 and 9), from which the distribution channels extend, that are obliquely disposed with respect to the associated platelets, so as to maximise the length of the edges from which the distribution channels radiate.

With the core arrangements as above described, heat exchange fluids will be directed into and through the core in a manner to establish a substantially uniform temperature distribution along the longitudinal axis of the core. Thus, the present invention avoids or, at least, reduces stress induced bending that is inherent in prior art heat exchangers. Such bending occurs as a consequence of the existence of a temperature gradient and resultant differential thermal expansion along the length of the core. Also, with the core arrangement as shown in FIGS. 5 to 7, two cores 10 may be mounted front-to-front (or back-to-back) as shown somewhat diagrammatically in FIG. 10 and be separated by barriers 35. A single header arrangement (not shown) may then be provided for delivering the heat exchange fluid $F_1$ to the central region 36 of the two-core arrangement and for conveying the fluid $F_1$ from side regions 37 of the two-core arrangement. Also, headers 38 may conveniently be secured to the four side portions of the two-core arrangement for delivering the fluid $F_2$ to the relevant plates of the two cores, and headers 39 may be connected to the back faces of the two cores for conveying the fluid $F_2$ from the two-core arrangement.

Figure 10:
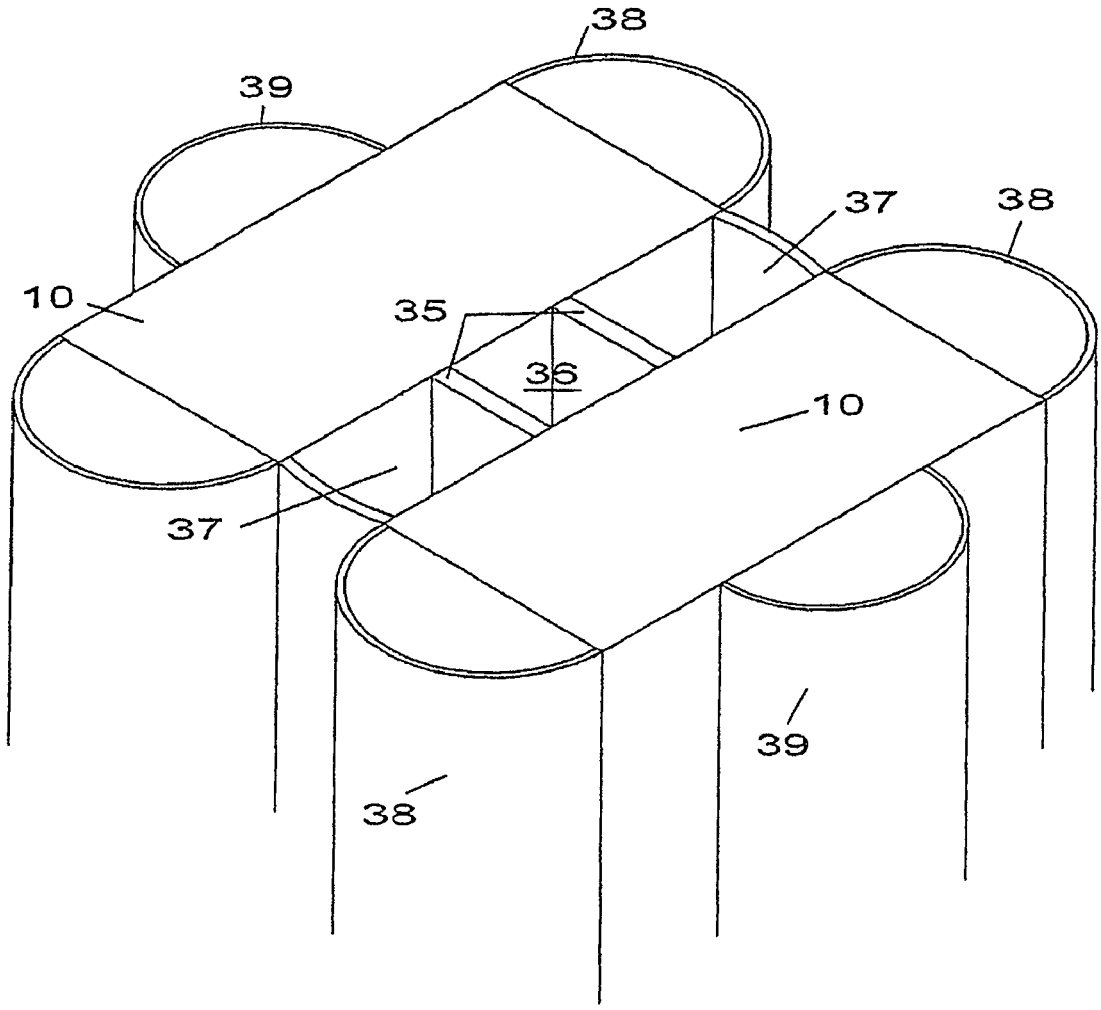
FIG. 10 shows (in outline) a perspective view of an upper portion of a complete heat exchanger that incorporates two cores of the type shown in FIGS. 6 and 7, but with some headers removed for illustrative purposes.

The vertically extending structure as shown in FIG. 10 comprises but one arrangement in which the invention might be embodied, but it does facilitate convenient ganging of four or six of the two-core arrangements about a common vertical axis. Also variations may be made in the structure as shown in FIG. 10. For example, a central web or bridge (not shown) may be positioned in each of the ports 28 and 31, and some fluid carrying bounding (end) plates in the core may be formed with approximately one-half of the number of channel-defining platelets as the remainder of the plates in the core for assisting equalisation of heat flows between plates in the core.

Figure 11:
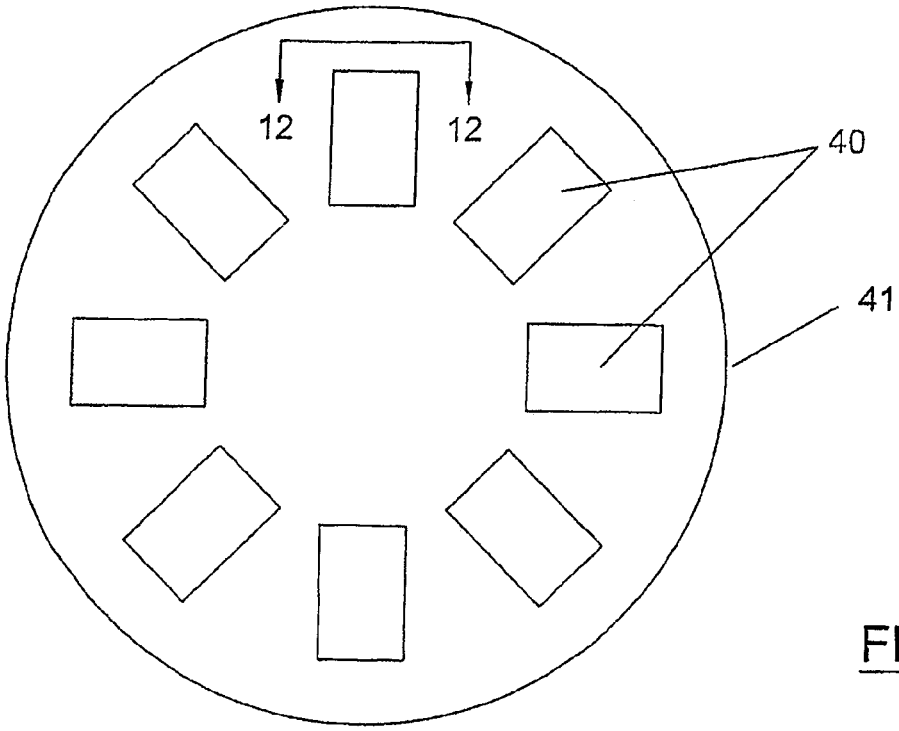
FIG. 11 shows diagrammatically an end view of cylindrical vessel containing eight heat exchangers, each of which comprises three linearly ganged cores of the above described type.

As another possible arrangement, a plurality of the cores 10 may be ganged linearly (ie, end-to-end) and, as shown diagrammatically in FIG. 11, a plurality of heat exchangers 40 constructed in this way may be housed within a cylindrical vessel 41. As illustrated, the ganged cores and the vessel extend longitudinally into the drawing.

A potential problem with the arrangement as illustrated in FIG. 11 is that, when exposed to normal service heating, each of the heat exchangers 40 will tend to bend (as a banana) in a manner such that the extreme end faces of the ganged cores will displace from their normal parallel relationship. This will create containment and/or coupling problems.

Figure 12:
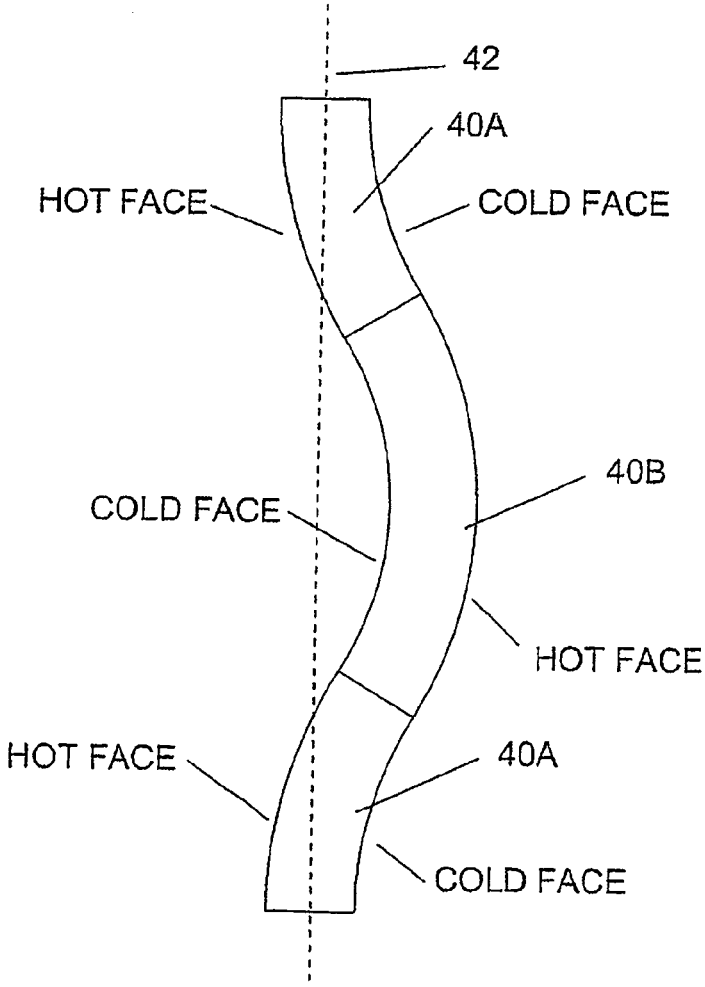
FIG. 12 shows a plan view, again diagrammatically, of one of the heat exchangers, as seen in the direction of arrows 12-12 in FIG. 11, when exposed to heat induced distortion.
Figure 13:
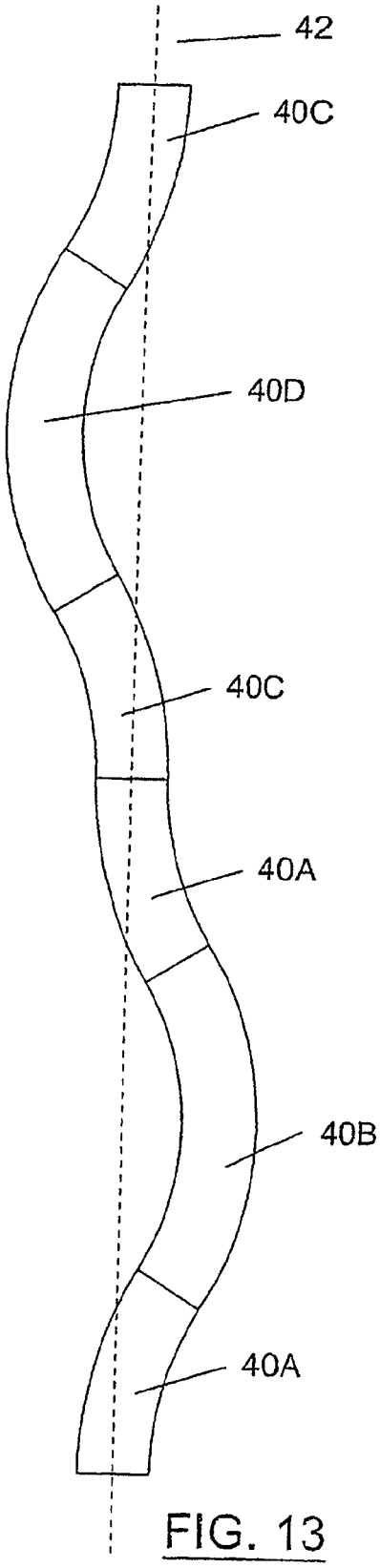
FIGS. 13 and 14 show views similar to that of FIG. 12 but with differently ganged arrangements of heat exchanger cores.
Figure 14:
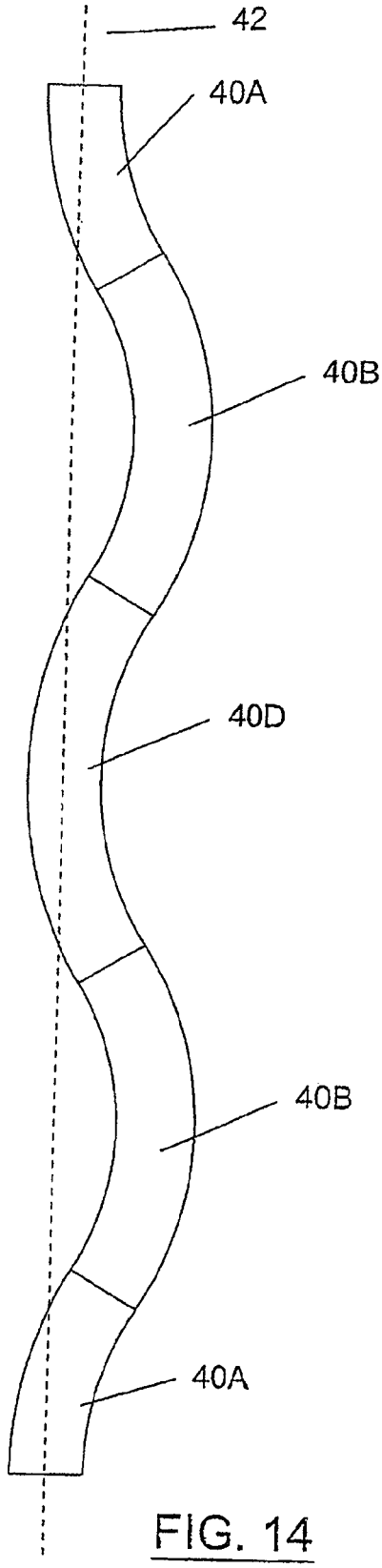

However, it is proposed that an accommodation might be made for these problems by ganging cores 40A to 40B of different lengths and by orienting the cores relative to one another in a manner such that compound bends are created and normals to centre-points of end faces of the ganged cores are maintained in substantially co-linear relationship. FIGS. 12, 13 and 14 show three examples of ganging arrangements that might be adopted using four heat exchanger cores 40A to 40D for this purpose. In these examples the same plate designs are used in cores 40A to 40D; core 40A is of equal length to core 40C, core 40B is of equal length to 40D, and cores 40A and 40C are half the length of cores 40B and 40D; core 40A differs from 40C and core 40B differs from 40D only in orientation and in the direction of flow of the heat exchange fluids.

The invention claimed is:

1. A heat exchanger core which comprises:

a) first and second groups of interleaved plates which are arranged respectively to carry first and second heat exchange fluids, the plates being bonded to one another and each of the plates in each group being formed in at least one of its faces with at least three platelets, each of which is composed of a group of parallel channels, each channel of which is formed in the first and second groups of plates to provide a tortuous path for the first and second heat exchange fluids, b) ports extending through the first and second groups of plates for conveying the first and second heat exchange fluids to and from the platelets, and c) a plurality of distribution channels connecting the group of channels at opposite ends of each platelet in each of the plates to associated ones of the ports in a manner such that a single group of the distribution channels connects only a single group of the channels to a single port at the end of each platelet, the distribution channels that are associated with each of the platelets in the plates of the first group being disposed in intersecting relationship with the distribution channels that are associated with respective ones of the platelets in the plates of the second group whereby each one of the platelets in the plates of the first group is located in heat exchange juxtaposition with a respective one of the platelets in the plates of the second group.

2. The heat exchanger core as claimed in claim 1 wherein the platelets are formed in one only of the faces of each of the plates of each group.

3. The heat exchanger core as claimed in claim 2 wherein the plates of the first and second groups are interleaved consecutively.

4. The heat exchanger core as claimed in claim 2 wherein, in at least a majority of the plates, a majority of the ports that convey the first and second heat exchange fluids from the platelets are connected by the distribution channels to two contiguous platelets.

5. The heat exchanger core as claimed in claim 1 wherein the ports that are located at the opposite ends of each platelet are not aligned.

6. The heat exchanger core as claimed in claim 1 wherein all of the ports extend through all of the plates of both the first and second groups of plates.

7. The heat exchanger core as claimed in claim 1 wherein each of the parallel channels is formed to follow a zig-zag path.

8. The heat exchanger core as claimed in claim 1 wherein each plate of each group is formed in one of its faces with between three and thirty contiguous said platelets.

9. The heat exchanger core as claimed in claim 1 wherein each platelet is composed of between twenty and forty parallel said channels.

10. The heat exchanger core as claimed in claim 1 wherein each said platelet in the plates of the first group has a size and shape substantially the same as the size and shape of each corresponding said platelet in the plates of the second group.

11. The heat exchanger core as claimed in claim 10 wherein each said platelet in the plates of the first group is positioned to overlie each corresponding said platelet in the plates of the second group.

12. The heat exchanger core as claimed claim 1 wherein the group of parallel channels of which each of the platelets is composed extends in a direction transversely across the platelet containing plate.

13. The heat exchanger core as claimed in claim 1 wherein the platelets in each plate are located parallel to one another and are arrayed in a single column.

14. The heat exchanger core as claimed in claim 1 wherein the platelets in each plate are located parallel to one another and are arrayed in two parallel columns.

15. The heat exchanger core as claimed in claim 14 wherein each column comprises between three and thirty contiguous said platelets.

16. A heat exchanger core which comprises:

a) first and second groups of interleaved plates which are arranged respectively to carry first and second heat exchange fluids, the plates being bonded to one another and each of the plates in each group being formed in at least one of its faces with at least three platelets, each of which is composed of a group of parallel channels, b) ports extending through the first and second groups of plates for conveying the first and second heat exchange fluids to and from the platelets, and c) distribution channels connecting opposite ends of each platelet in each of the plates to associated ones of the ports, the distribution channels that are associated with each of the platelets in the plates of the first group being disposed in intersecting relationship with the distribution channels that are associated with respective ones of the platelets in the plates of the second group whereby each one of the platelets in the plates of the first group is located in heat exchange juxtaposition with a respective one of the platelets in the plates of the second group;

wherein the platelets in each plate are located parallel to one another and are arrayed in two parallel columns; and wherein each of the plates is formed with six longitudinally extending arrays of the ports, a first of which is located centrally of the plate, a second and third of which are positioned within respective side margins of the plate, a fourth and fifth of which comprise ports that extend inwardly from the respective side margins of the plate, and the sixth of which is located centrally of the plate and interspersed with the ports of the first array.

17. The heat exchanger core as claimed in claim 16 wherein the first and the sixth arrays of the ports are accessed from opposite end faces of the core.

18. The heat exchanger core as claimed in claim 16 wherein the second and the third arrays of the ports are accessed from one of the end faces of the core.

19. The heat exchanger core as claimed in claim 16 wherein the fourth and fifth arrays are accessed from opposite side faces respectively of the core.

20. The heat exchanger core as claimed in claims 16 wherein respective ports of the first, fourth and fifth arrays are aligned in the transverse direction of each plate, and respective ports of the second, third and fifth arrays are aligned in the transverse direction of each plate.

21. The heat exchanger core as claimed in claim 16 wherein:

the first array of ports is arranged in use to receive inflow of the first heat exchange fluid, the second and third arrays of ports are arranged in use to provide outflow of the first heat exchange fluid, the fourth and fifth arrays of ports is are arranged in use to receive inflow of the second heat exchange fluid, and the sixth array of ports is arranged in use to provide outflow of the second heat exchange fluid.

22. The heat exchanger core as claimed in claim 1 wherein each of the ports has an edge portion that is located obliquely with respect to its associated platelets.

23. The heat exchanger core as claimed in claim 1 wherein all of the plates are diffusion bonded to one another.

24. The heat exchanger core as claimed in claim 1 wherein all of the channels and the distribution channels have substantially the same cross-sectional shape and dimensions.

25. The heat exchanger as claimed in claim 1 wherein each of the distribution channels is connected directly to only an associated one of the platelet-forming channels and only one of the ports.

26. A heat exchanger incorporating at least one core as claimed in claim 1.

27. The heat exchanger as claimed in claim 26 and including headers connected to the core for conveying first and second heat exchange fluids to and from the core.

28. A heat exchanger assembly incorporating at least two cores as claimed claim 1.

29. A heat exchanger core which comprises:

a) first and second groups of interleaved plates which are arranged respectively to carry first and second heat exchange fluids, the plates being bonded to one another and each of the plates in each group being formed in at least one of its faces with at least three platelets, each of which is composed of a group of parallel channels, b) ports extending through the first and second groups of plates for conveying the first and second heat exchange fluids to and from the platelets, and c) a plurality of distribution channels connecting the group of channels at opposite ends of each platelet in each of the plates to associated ones of the ports, the distribution channels that are associated with each of the platelets in the plates of the first group being disposed in intersecting relationship with the distribution channels that are associated with respective ones of the platelets in the plates of the second group whereby each one of the platelets in the plates of the first group is located in heat exchange juxtaposition with a respective one of the platelets in the plates of the second group;

wherein each port that conveys the first and second heat exchange fluids to the platelets is in fluid communication with only one of the at least three platelets.

* * * * *